US009792862B2

(12) United States Patent
Hung et al.

(10) Patent No.: US 9,792,862 B2
(45) **Date of Patent: *Oct. 17, 2017**

(54) METHOD AND DRIVING APPARATUS FOR OUTPUTTING DRIVING SIGNAL TO DRIVE ELECTRO-PHORETIC DISPLAY

(71) Applicant: E Ink Holdings Inc., Hsinchu (TW)

(72) Inventors: Chi-Mao Hung, Taoyuan (TW); Pei-Lin Tien, Taoyuan (TW)

(73) Assignee: E Ink Holdings Inc., Hsinchu (TW)

( * ) Notice: Subject to any disclaimer, the term of this patent is extended or adjusted under 35 U.S.C. 154(b) by 12 days.

This patent is subject to a terminal disclaimer.

(21) Appl. No.: 14/941,682

(22) Filed: Nov. 16, 2015

(65) Prior Publication Data

US 2016/0071465 A1 Mar. 10, 2016

Related U.S. Application Data

(63) Continuation-in-part of application No. 13/743,344, filed on Jan. 17, 2013, now Pat. No. 9,218,773.

(51) Int. Cl.
*G09G 3/34* (2006.01)

(52) U.S. Cl.
CPC ..... *G09G 3/344* (2013.01); *G09G 2310/0254* (2013.01); *G09G 2320/041* (2013.01)

(58) Field of Classification Search
None
See application file for complete search history.

(56) References Cited

U.S. PATENT DOCUMENTS 7,557,960 B2 * 7/2009 Ishida ..... H04N 1/4015 345/589
2013/0342107 A1 * 12/2013 Haacke ..... H05B 41/2926 315/118

* cited by examiner

*Primary Examiner* — David D Davis
(74) *Attorney, Agent, or Firm* — Jianq Chyun IP Office

(57) ABSTRACT

The present invention provides a driving apparatus, the driving apparatus is used for outputting a driving signal to drive an electro-phoretic display, and the driving apparatus includes a driving signal generator, a temperature sensor, and a selector. The driving signal generator generates a plurality of periodic alternative current signals and a plurality of direct current signals. The temperature sensor generates a temperature parameter by sensing an environment temperature. The selector is coupled to the driving signal generator and the temperature sensor. The selector selects one of the periodic alternative current signals or one of the direct current signals as the driving signal according to the temperature parameter. The driving signal is a common voltage for the electro-phoretic display, and when one of the periodic alternative current signals is selected as the driving signal, an amplitude of the driving signal is varied with the environment temperature.

20 Claims, 5 Drawing Sheets

METHOD AND DRIVING APPARATUS FOR OUTPUTTING DRIVING SIGNAL TO DRIVE ELECTRO-PHORETIC DISPLAY

CROSS-REFERENCE TO RELATED APPLICATION

This application is a continuation-in-part application of and claims the priority benefit of U.S. application Ser. No. 13/743,344, filed on Jan. 17, 2013, now allowed. The entirety of the above-mentioned patent application is hereby incorporated by reference herein and made a part of this specification.

BACKGROUND OF THE INVENTION

Field of Invention

The present invention generally relates to an apparatus for generating a driving signal to drive an electro-phoretic display (EPD), and more particularly to, an apparatus for generating a common voltage for the EPD.

Description of Prior Art

In conventional driving structure, a common voltage is necessary for driving an electro-phoretic display (EPD). The common voltage can be set to be a direct current (DC) signal or an alternating current (AC) signal. Please notice here, in the conventional EPD, once the common voltage is set to be the DC voltage signal or the AC voltage signal, the style of the common voltage can not be changed when the EPD is operated. That is, the conventional EPD is driven by the common voltage in a fix style regardless the environment temperature. In this condition, when the conventional EPD is used in a place with related low environment temperature, a driving time is increased, and the performance of the conventional EPD is reduced correspondingly.

SUMMARY OF THE INVENTION

The present invention provides a driving apparatus for increasing a performance of an electro-phoretic display (EPD)

The present invention also provides a method for outputting a driving signal to drive an EPD, and the performance of the EPD is increased correspondingly.

The present invention provides a driving apparatus, the driving apparatus is used for outputting a driving signal to drive an electro-phoretic display, and the driving apparatus includes a driving signal generator, a temperature sensor, and a selector. The driving signal generator generates a plurality of periodic alternative current signals and a plurality of direct current signals. The temperature sensor generates a temperature parameter by sensing an environment temperature. The selector is coupled to the driving signal generator and the temperature sensor. The selector selects one of the periodic alternative current signals or one of the direct current signals as the driving signal according to the temperature parameter.

The present invention also provides a method for generating a driving signal to drive an electro-phoretic display. The steps of the method includes: generating a plurality of periodic alternative current signals and a plurality of direct current signals;

generating a temperature parameter by sensing an environment temperature; and selecting one of the periodic alternative current signals or one of the direct current signals as the driving signal according to the temperature parameter.

In one exemplary embodiment of the present invention, the driving signal is a common voltage for the electro-phoretic display, and when one of the periodic alternative current signals is selected as the driving signal, an amplitude of the driving signal is varied with the environment temperature.

In one exemplary embodiment of the present invention, the driving signal is dynamically changed among the plurality of periodic alternative current signals and the plurality of direct current signals in response to the temperature parameter when the electro-phoretic display is in operation.

According to the above descriptions, in the invention, the driving signal is generated by selecting one of the direct current signals or one of the periodic alternative current signals according to the environment temperature. That is, the style of the driving signal can be dynamically changed during the EPD is operating, and a better style of the driving signal can be selected according to the environment temperature for increasing the performance of the EPD.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

VAC1-VACM according to yet embodiment of the present invention.

Figure 3:
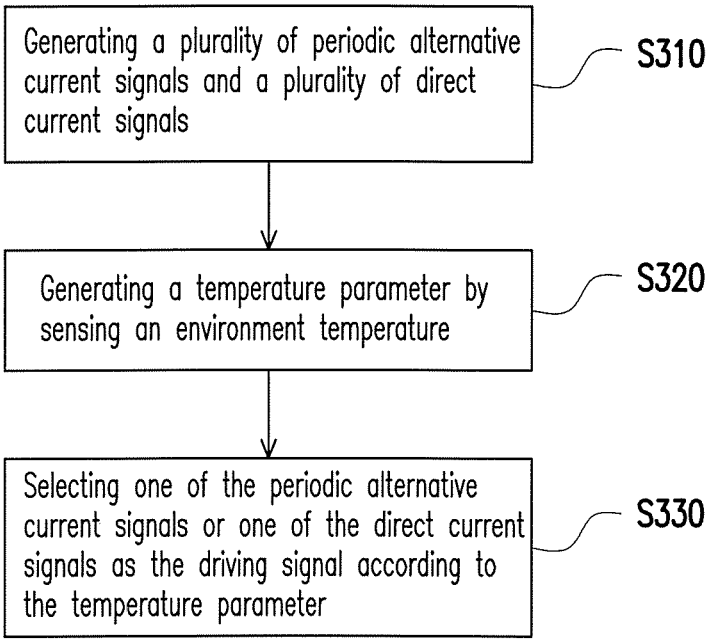

FIG. 3 is a flow chart of a method for generating a driving signal to drive an electro-phoretic display according to an embodiment of the present invention.

DESCRIPTION OF THE EMBODIMENTS

Reference will now be made in detail to the present preferred embodiment of the invention, examples of which are illustrated in the accompanying drawings. Wherever possible, the same reference numbers are used in the drawings and the description to refer to the same or like parts.

Figure 1:
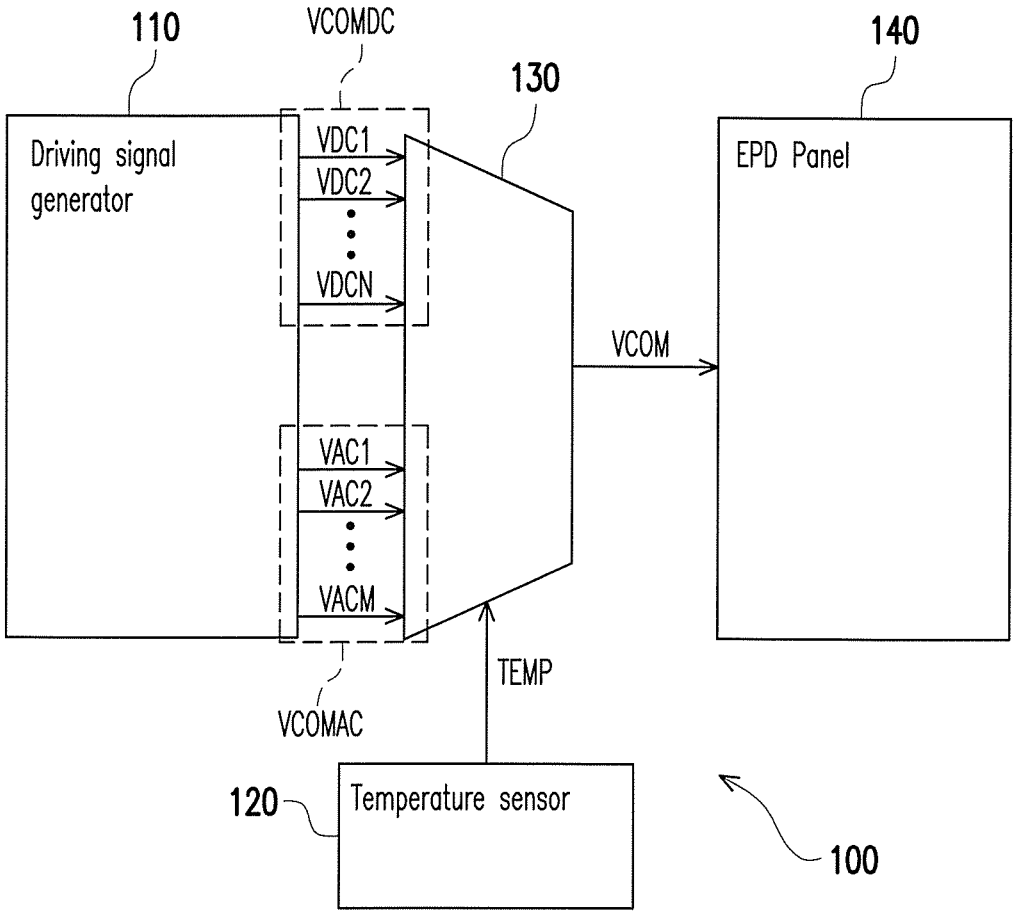
FIG. 1 is a block diagram of a driving apparatus 100 according to an embodiment of the present invention.

Referring to FIG. 1, FIG. 1 is a block diagram of a driving apparatus 100 according to an embodiment of the present invention. The driving apparatus 100 includes a driving signal generator 110, a temperature sensor 120 and a selector 130. The driving signal generator 110 generates a plurality of periodic alternative current signals VAC1-VACM and a plurality of direct current signals VDC1-VDCN. The temperature sensor 120 is used to sense an environment temperature and generates a temperature parameter TEMP accordingly (i.e. the temperature parameter TEMP may be equal to or related to the environment temperature). The selector 130 is coupled to the driving signal generator 110 and the temperature sensor 120. The selector 130 receives the periodic alternative current signals VAC1-VACM and the direct current signals VDC1-VDCN, and further receives the temperature parameter TEMP. The selector 130 selects one of the periodic alternative current signals VAC1-VACM or one of the direct current signals VDC1-VDCN as the driving signal VCOM according to the temperature parameter TEMP, wherein the driving signal VCOM may be a common voltage for the EPD panel 140.

In detail, the driving signal generator 110 generates the periodic alternative current signals VAC1-VACM and the direct current signals VDC1-VDCN. The periodic alternative current signals VAC1-VACM may be arranged into a group VCOMAC, and the direct current signals VDC1-VDCN may be arranged into another group VCOMDC. Both the periodic alternative current signals VAC1-VACM and the direct current signals VDC1-VDCN are transported to the selector 130. The selector 130 further receives the temperature parameter TEMP. The selector 130 generates the driving signal VCOM from the group VCOMDC or VCOMAC according to the temperature parameter TEMP. For example, the selector 130 judges whether the temperature parameter TEMP is larger than a preset threshold value related to the environment temperature or not. When the temperature parameter TEMP is not larger than the preset threshold value, the selectors 130 generates the driving signal VCOM by selecting one the periodic alternative current signals VAC1-VACM in the group VCOMAC. On the contrary, when the temperature parameter TEMP is larger than the preset threshold value, the selectors 130 generates the driving signal VCOM by selecting one of the direct current signals VDC1-VDCN in the group VCOMDC.

Besides, the preset threshold value is preset by a designer of the driving apparatus 100. The designer may set the preset threshold value by his experience or/and an environment which the EPD panel 140 belonged to.

In this embodiment, each of the periodic alternative current signals VAC1-VACM is corresponded to one of a plurality of first temperature intervals by a first relationship. For example, if all of the first temperature intervals are equal to 5° C., and the preset threshold value is equal to 20° C. The selector 130 may select the periodic alternative current signal VAC1 to be the driving signal VCOM when the environment temperature is between 20° C.-15° C. (=20° C.−5° C.). Moreover, the selector 130 may select the periodic alternative current signal VAC2 to be the driving signal VCOM when the environment temperature is between 15° C.-10° C. (−15° C.−5° C.).

On the other hand, the first temperature intervals may be different. For example, the first temperature interval corresponded to the periodic alternative current signal VAC1 is 7° C., and the first temperature interval corresponded to the periodic alternative current signal VAC2 is 5° C. Then, selector 130 may select the periodic alternative current signal VAC1 to be the driving signal VCOM when the environment temperature is between 20° C. to 13° C. (=20° C.−7° C.). . Moreover, the selector 130 may select the periodic alternative current signal VAC2 to be the driving signal VCOM when the environment temperature is between 13° C. to 8° C. (=13° C.−5° C.). In addition, the first relationship of each of the first temperature intervals may be set by the designer, and the first relationship may be fixed or adjusted dynamically when the driving apparatus 100 is operating.

In this embodiment, each of the direct current signals VDC1-VDCN is corresponded to one of a plurality of second temperature intervals by a second relationship. For example, if all of the second temperature intervals are equal to 5° C., and the preset threshold value is equal to 20° C. The selector 130 may select the direct current signal VDC1 to be the driving signal VCOM when the environment temperature is between 20° C.-25° C. (=20° C.+5° C.). Moreover, the selector 130 may select the direct current signal VDC2 to be the driving signal VCOM when the environment temperature is between 25° C.-30° C. (=25° C.+5° C.).

On the other hand, the second temperature intervals may be different. For example, the second temperature interval corresponded to the direct current signal VDC1 is 7° C., and the second temperature interval corresponded to the direct current signal VDC2 is 5° C. Then, selector 130 may select the direct current signal VDC1 to be the driving signal VCOM when the environment temperature is between 20° C. to 27° C. (=20° C.+7° C.). Moreover, the selector 130 may select the direct current signal VDC2 to be the driving signal VCOM when the environment temperature is between 27° C. to 32° C. (=27° C.+5° C.). In addition, the second relationship of each of the first temperature intervals may be set by the designer, and the second relationship may be fixed or adjusted dynamically when the driving apparatus 100 is operating.

Figure 2A:
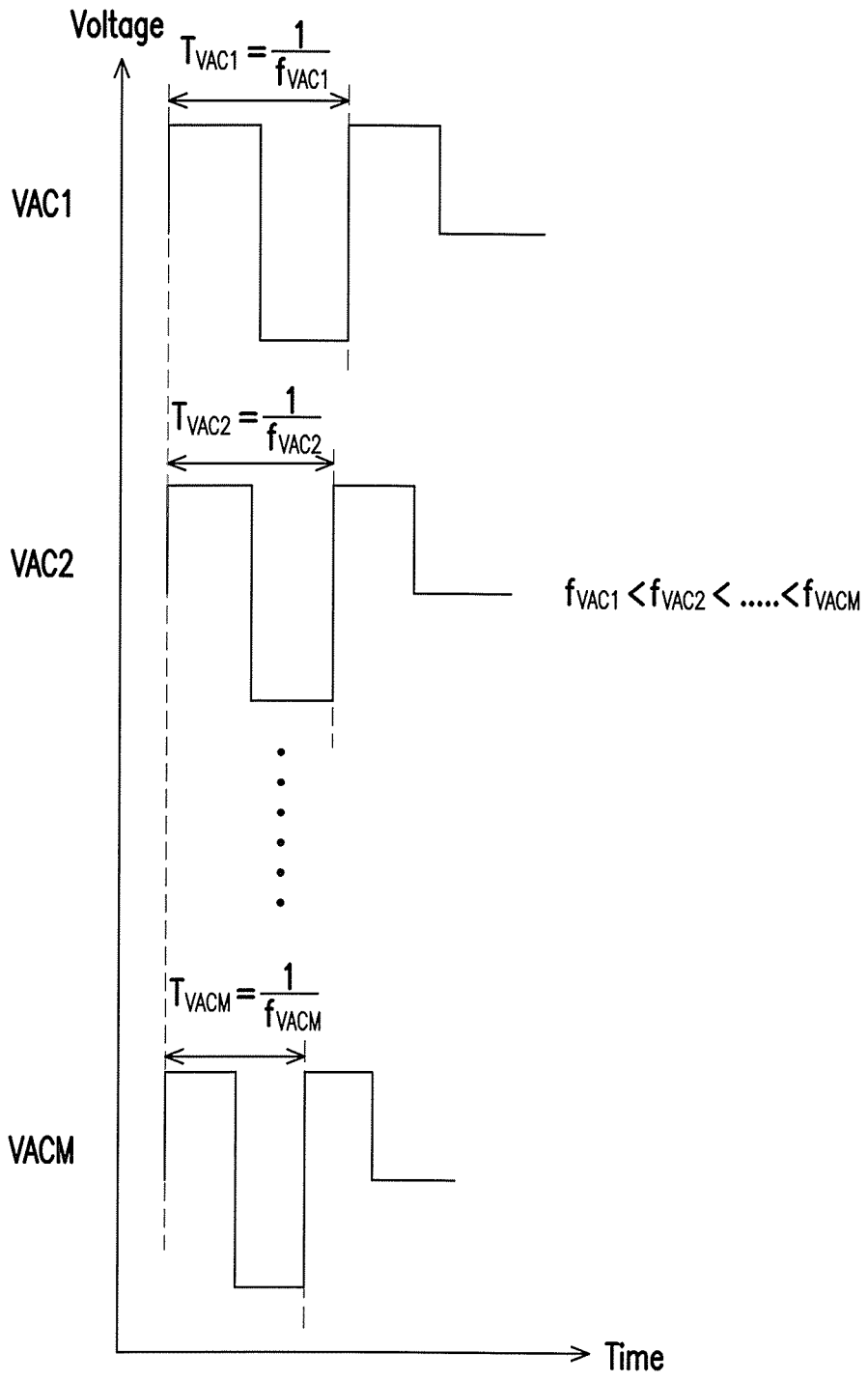
FIG. 2A is a waveform plot of the periodic alternative current signals VAC1-VACM according to an embodiment of the present invention.

Referring to FIG. 1 and FIG. 2A, FIG. 2A is a waveform plot of the periodic alternative current signals VAC1-VACM according to an embodiment of the present invention. In FIG. 2, frequencies ($f_{VAC1}$-$f_{VACM}$) of the periodic alternative current signals VAC1-VACM are different. In this case, when the selector 130 selects one of the periodic alternative current signals VAC1-VACM to be the driving signal VCOM, the frequency (f) of the driving signal VCOM is varied according to the environment temperature. In other words, as shown in FIG. 2A, the frequency (f) of the driving signal VCOM gradually increases as the environment temperature decreases (i.e. $f_{VAC1}<f_{VAC2}< \ldots <f_{VACM}$), but the present invention is not limited thereto.

Figure 2B:
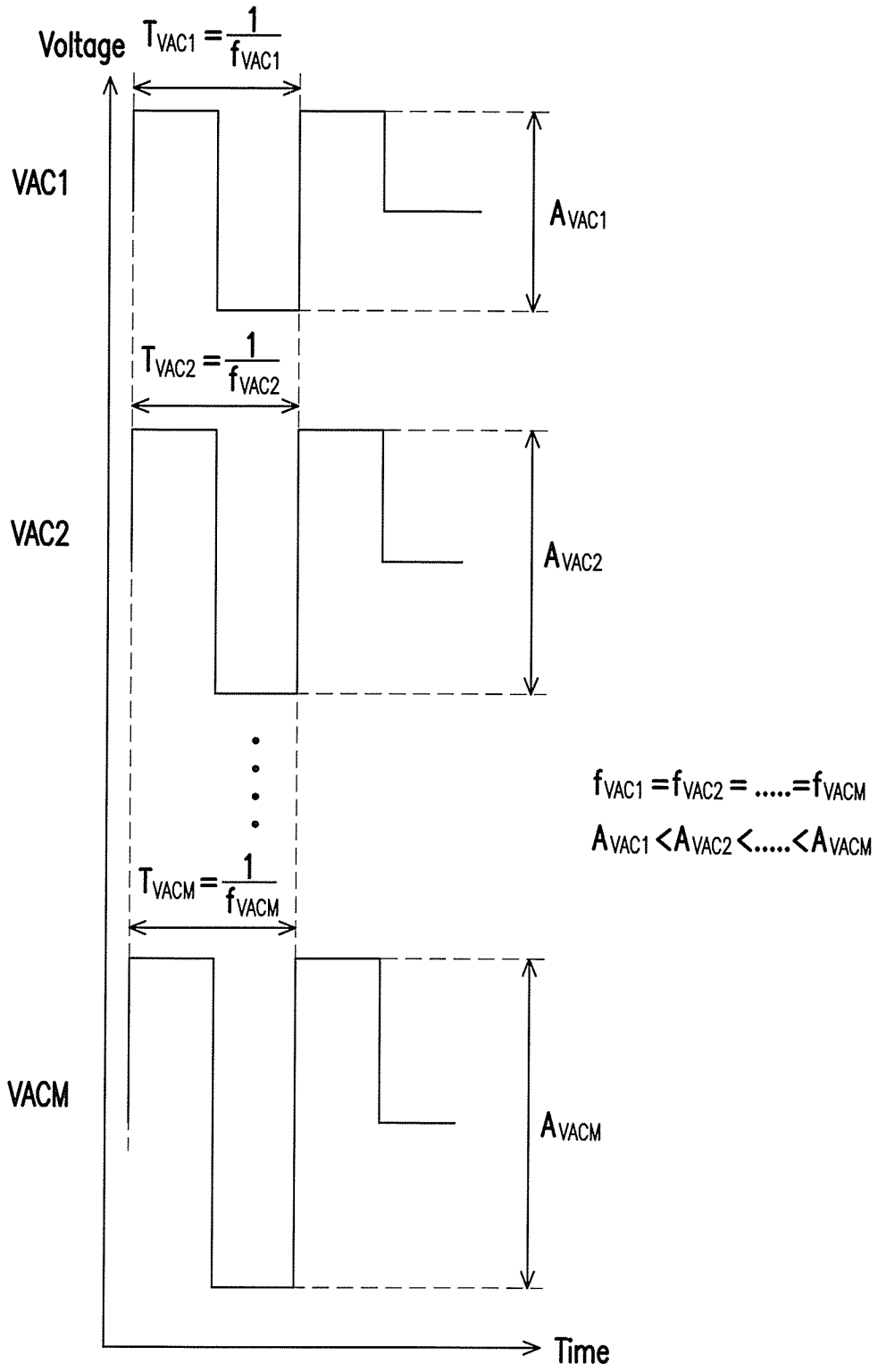
FIG. 2B is a waveform plot of the periodic alternative current signals VAC1-VACM according to another embodiment of the present invention.

To be specific, FIG. 2B is a waveform plot of the periodic alternative current signals VAC1-VACM according to another embodiment of the present invention. In FIG. 2B, frequencies ($f_{VAC1}$-$f_{VACM}$) of the periodic alternative current signals VAC1-VACM are the same, but amplitudes (peak-to-peak voltages, $A_{VAC1}$-$A_{VACM}$) of the periodic alternative current signals are different. In this case, when the selector 130 selects one of the periodic alternative current signals VAC1-VACM to be the driving signal VCOM, the amplitude (A) of the driving signal VCOM is varied according to the environment temperature. In other words, as shown in FIG. 2B, the amplitude (A) of the driving signal VCOM gradually increases as the environment temperature decreases (i.e. $A_{VAC1}<A_{VAC2}< \ldots <A_{VACM}$), and the frequency (f) of the driving signal VCOM is fixed (i.e. $f_{VAC1}-f_{VAC2}= \ldots = f_{VACM}$).

Figure 2C:
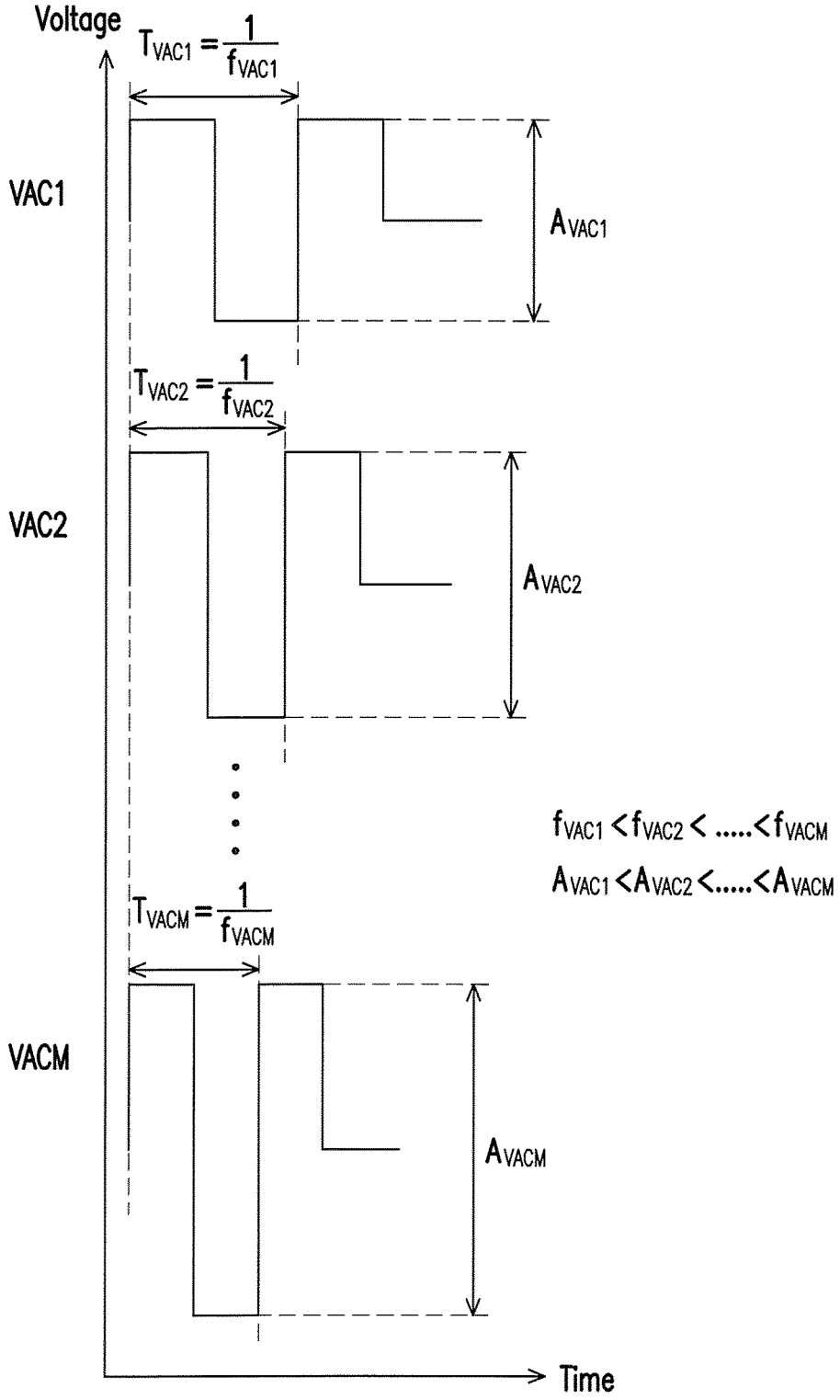
FIG. 2C is a waveform plot of the periodic alternative current signals

Moreover, FIG. 2C is a waveform plot of the periodic alternative current signals VAC1-VACM according to yet embodiment of the present invention. In FIG. 2C, both frequencies ($f_{VAC1}$-$f_{VACM}$) and amplitudes (peak-to-peak voltages, $A_{VAC1}$-$A_{VACM}$) of the periodic alternative current signals VAC1-VACM are different. In this case, when the selector 130 selects one of the periodic alternative current signals VAC1-VACM to be the driving signal VCOM, both the frequency (f) and the amplitude (A) of the driving signal VCOM are varied according to the environment temperature. In other words, as shown in FIG. 2C, both the frequency (f) and the amplitude (A) of the driving signal VCOM gradually increases as the environment temperature decreases, namely, $f_{VAC1}<f_{VAC2}< \ldots <f_{VACM}$ and $A_{VAC1}<A_{VAC2}< \ldots <A_{VACM}$.

On the other hand, voltage levels of the direct current signals VDC1-VDCN are different. Therefore, when the selector 130 selects one of the direct current signals VDC1-VDCN to be the driving signal VCOM, the voltage level of the driving signal VCOM is varied according to the environment temperature.

Referring to FIG. 3, FIG. 3 is a flow chart of a method for generating a driving signal to drive an electro-phoretic display according to an embodiment of the present invention. The steps of the method for generating a driving signal includes: generating a plurality of periodic alternative current signals and a plurality of direct current signals (S310); generating a temperature parameter by sensing an environment temperature (S320); and selecting one of the periodic alternative current signals or one of the direct current signals as the driving signal according to the temperature parameter (S330). It is noted that, in other exemplary embodiment, the step S310 may not necessary, and in this condition, the step S330 may be modified as "selecting one of the periodic alternative current signals or one of the direct current signals as the driving signal according to an environment temperature".

In summary, the present disclosure provides a selector to select one of one of the periodic alternative current signals or one of the direct current signals as the driving signal according to the temperature parameter or the environment temperature. Therefore, the voltage level or the frequency of the driving signal may be adjusted according to the environment temperature or the environment temperature, and the performance of the EPD is increased correspondingly.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A driving apparatus for outputting a driving signal to drive an electro-phoretic display, comprising:

a driving signal generator, for generating a plurality of periodic alternative current signals and a plurality of direct current signals;

a temperature sensor, generating a temperature parameter by sensing an environment temperature; and a selector, coupled to the driving signal generator and the temperature sensor, the selector selecting one of the periodic alternative current signals or one of the direct current signals as the driving signal according to the temperature parameter, wherein the driving signal is a common voltage for the electro-phoretic display, and when the selector selects one of the periodic alternative current signals as the driving signal, an amplitude of the driving signal is varied with the environment temperature.

2. The driving apparatus according to claim 1, wherein the driving signal is dynamically changed among the plurality of periodic alternative current signals and the plurality of direct current signals in response to the temperature parameter when the electro-phoretic display is in operation.

3. The driving apparatus according to claim 2, wherein when the temperature parameter is not larger than a preset threshold value related to the environment temperature, the selector selects one of the periodic alternative current signals as the driving signal.

4. The driving apparatus according to claim 3, wherein amplitudes of the periodic alternative current signals are different, and the amplitude of the driving signal gradually increases as the environment temperature decreases.

5. The driving apparatus according to claim 4, wherein a frequency of the driving signal is either fixed or varied with the environment temperature.

6. The driving apparatus according to claim 5, wherein when the frequency of the driving signal is varied with the environment temperature, frequencies of the periodic alternative current signals are different, and the frequency of the driving signal gradually increases as the environment temperature decreases.

7. The driving apparatus according to claim 3, wherein, each of the periodic alternative current signals is corresponded to one of a plurality of first temperature intervals by a first relationship, and the selector selects one of the periodic alternative current signals as the driving signal according to the temperature parameter and the first relationship.

8. The driving apparatus according to claim 2, wherein when the temperature parameter is larger than the preset threshold value, the selector selects one of the direct current signals as the driving signal.

9. The driving apparatus according to claim 8, wherein voltage levels of the direct current signals are different.

10. The driving apparatus according to claim 8, wherein each of the direct current signals is corresponded to one of a plurality of second temperature intervals by a second relationship, and the selector selects one of the direct current signals as the driving signal according to the temperature parameter and the second relationship.

11. A method for generating a driving signal to drive an electro-phoretic display, comprising:

generating a plurality of periodic alternative current signals and a plurality of direct current signals; and selecting one of the periodic alternative current signals or one of the direct current signals as the driving signal according to an environment temperature, wherein the driving signal is a common voltage for the electro-phoretic display, and when one of the periodic alternative current signals is selected as the driving signal, an amplitude of the driving signal is varied with the environment temperature.

12. The method according to claim 11, wherein the driving signal is dynamically changed among the plurality of periodic alternative current signals and the plurality of direct current signals in response to the environment temperature when the electro-phoretic display is in operation.

13. The method according to claim 12, wherein the step of selecting one of the periodic alternative current signals or one of the direct current signals as the driving signal according to the environment temperature comprises:

selecting one of the periodic alternative current signals as the driving signal when the environment temperature is not larger than a preset threshold value related to the environment temperature.

14. The method according to claim 13, wherein amplitudes of the periodic alternative current signals are different, and the amplitude of the driving signal gradually increases as the environment temperature decreases.

15. The method according to claim 14, wherein a frequency of the driving signal is either fixed or varied with the environment temperature.

16. The method according to claim 15, wherein when the frequency of the driving signal is varied with the environment temperature, frequencies of the periodic alternative current signals are different, and the frequency of the driving signal gradually increases as the environment temperature decreases.

17. The method according to claim 13, wherein each of the periodic alternative current signals is corresponded to one of a plurality of first temperature intervals by a first relationship, and the step of selecting one of the periodic alternative current signals as the driving signal comprises:

selecting one of the periodic alternative current signals as the driving signal according to the environment temperature and the first relationship.

18. The method according to claim 12, wherein the step of selecting one of the periodic alternative current signals or one of the direct current signals as the driving signal according to the environment temperature comprises:

selecting one of the direct current signals as the output signal when the environment temperature is larger than the preset threshold value related to the environment temperature.

19. The method according to claim 18, wherein voltage levels of the direct current signals are different.

20. The method according to claim 18, wherein each of the direct current signals is corresponded to one of a plurality of second temperature intervals by a second relationship, and the step of selecting one of the direct current signals as the driving signal comprises:

selecting one of the direct current signals as the driving signal according to the environment temperature and the second relationship.

* * * * *